United States Patent [19]

Kliot

[11] 4,077,436

[45] Mar. 7, 1978

[54] PORTABLE HAND WEAVING LOOM

[76] Inventor: Jules Kliot, 2150 Stuart St., Berkeley, Calif. 94705

[21] Appl. No.: 798,424

[22] Filed: May 19, 1977

[51] Int. Cl.[2] ..... D03D 29/00

[52] U.S. Cl. ..... 139/34; 28/149

[58] Field of Search ..... 139/29, 33, 34; 28/149–, 152

[56] References Cited

U.S. PATENT DOCUMENTS

| | | | |
|---|---|---|---|
| 1,975,924 | 10/1934 | Collingbourne | 28/151 |
| 2,077,532 | 4/1937 | Rossiter | 139/34 |
| 3,724,041 | 4/1973 | Cleverley | 139/34 |

*Primary Examiner*—Henry S. Jaudon

[57] ABSTRACT

An apparatus for weaving having two normally stiff flat springy pieces forming the base which, by varying their relationship to each other, can exert varying degrees of tension on the supported warp threads which extend, in a continuous fashion, completely around both faces of the base, the warp being applied with the base in a flat position so that the base assumes a bowed configuration when the relationship of the two pieces forming the base are altered, with the tendency of the base to return to its normally straight position acting to keep the warp threads in tension.

3 Claims, 5 Drawing Figures

PORTABLE HAND WEAVING LOOM

BACKGROUND OF THE INVENTION

1. Field of the Invention

This invention relates to portable hand looms capable of being packaged in a relatively small space and capable of being manufactured of such inexpensive materials, such as cardboard, so as to be considered disposable in nature.

2. Prior Art

Looms used for weaving usually have a base of essentially fixed dimension over which the warp threads are maintained in a taut condition for application of the weft or cross threads. Tension in the warp is generally maintained and controlled by some anciallary means to take into account adjustments required for warp take-up as the weaving progresses as well as warp relaxation when the loom is not being used. Without a means for warp control, looms must be limited in size being restricted to relatively small weavings.

Where compactness is of importance, such as in merchandising of a weaving kit which would include a loom for working a single relatively large weaving and where it is essential to maximize the number of displayed units, a foldable loom, low in cost, of limited use and independent of the size of the finished weaving is of much value.

SUMMARY OF THE INVENTION

The present invention provides a loom which is particularly suited for construction of inexpensive materials such as cardboard which can be produced in quantity and economically on modern die-cutting machines, so as to be considered disposable, which can be folded to relatively small size, which is so constructed that the entire warp can be applied as one continuous thread, that creates a continuous warp which can be rotated around the loom as the weaving progresses, that can control and equalize tension, that can change it physical lateral dimension to allow for warp take-up and complete tension control.

With the advant of craft hobbies calling for the merchandising of prepared kits to complete specific projects, compact, inexpensive, portable looms are desired which are capable of weaving relatively large pieces. Compactness is of importance for purposes of packaging, shipping and display. For teaching and classroom use, where each student would require the use of a loom for both in and out of classroom working, an inexpensive loom which can become the property of the student would be of much value. This present loom satisfies all these requirements being simple in form, relatively easy to set up and work, and capable of weaving relatively large pieces.

The loom of the present invention can be collapsed and folded into a small flat package suitable for carrying in a notebook, purse or pocket and is easily set into working condition.

The loom includes a base formed of two independent elements which can be maintained in any of various fixed positions relative to each other, each element made of a stiff springy material adapted to be bowed. The relative positions of the two base elements can be altered before or after the warp is prepared, enabling the elements to assume a flat or various degrees of a bowed configuration, depending on desired warp tension.

A detailed description following, related to drawings, gives exemplification of this loom according to the invention which, however, it capable of expression in means other then those particularly described and illustrated.

DETAILED DESCRIPTION

Figure 1:
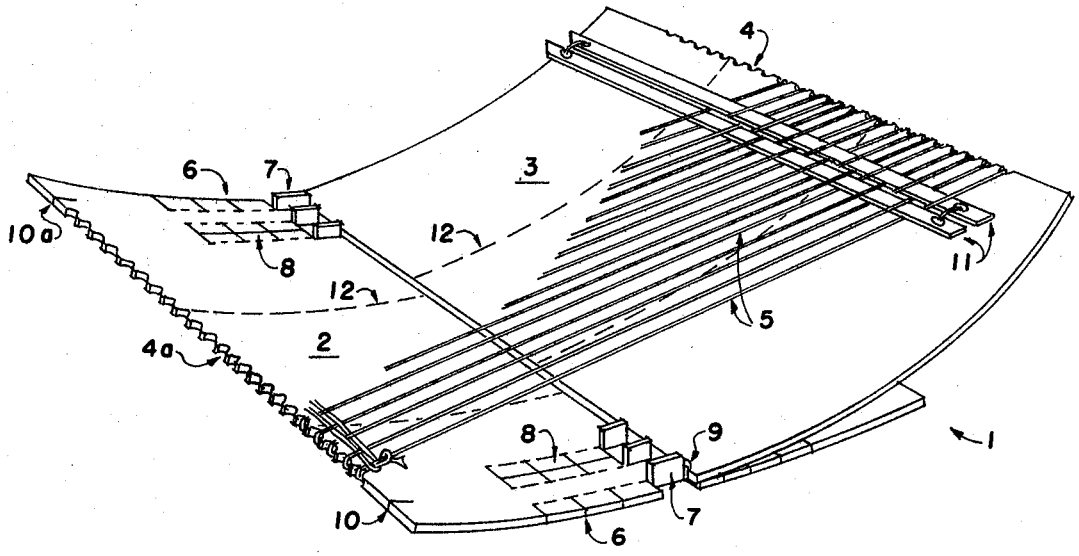
FIG. 1 is a perspective view of a preferred embodiment of the loom warped and having a fabric partially woven.
Figure 2:
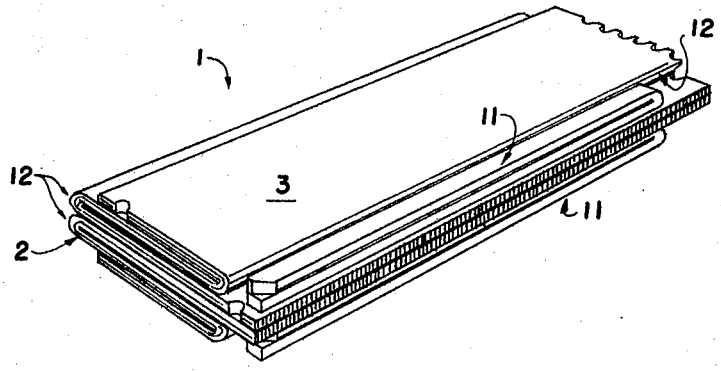
FIG. 2 is a perspective view of the folded loom.

FIGS. 1 & 2 show one embodiment of a loom of this invention, 1. As seen in FIG. 1, the loom has a base of two elements, a bottom forward element 2 and a top rear element 3 which are formed of a stiff material, preferably cardboard, of such consistency that it can bend to some extent without breaking. At least one longitudional straight edge of each element is preferably provided with grooves 4 and **4*a* to uniformly space the warp threads 5. On the two lateral sides of the bottom base element 2, spaced cuts 6 are provided to permit the forming of any of possible raised tabs 7 when any section between two cuts is bent up 90°. Additional rows of edge tabs 8 could be provided along lines parallel to the lateral edge as might be required for additional strength. A notch 9 is provided along the inner longitudional edge of the top element 3 to engage a selected edge tap of element 2 and assure alignment. A warp holding notch 10 and 10*a* is provided at each end of notched edge 4*a* to secure warp ends during the warping process. Scored lines 12, forming unequal seqments, are provided for folding the loom and are arranged so that when the two base elements 2 and 3 are positioned, the fold lines do not align. Lease sticks 11, two narrow strips of stiff material, woven through the warp and tied together, is a preferred method of maintaining warp thread alignment. Size of both base elements is preferably identical with the width or longitudional dimension equal to slightly more then the desired weaving width while the depth or lateral dimension of the assembled base is slightly more then one-half the desired weaving length. In the assembled weaving position, FIG. 1, the base elements should overlap approximately one-third of the total base lateral dimension. For simplicity of manufacture and interchangeability of base elements, both elements 2 and 3** would preferably be made identical.

FIG. 2 is a perspective view of the completely folded loom indicating a suggested folding pattern for each of elements 2 and 3 and lease sticks 11, with scored lines 12 forming unequal seqments.

OPERATION

Figure 3:
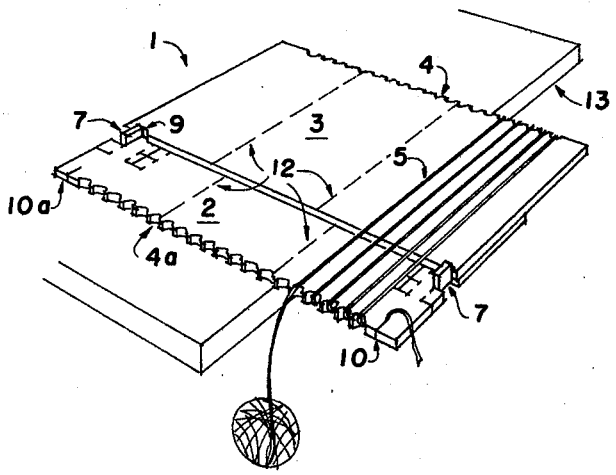
FIG. 3 is a perspective view of the loom in warping condition with warp partially prepared.

Referring to FIG. 3, in preparing the loom for warping, the two base elements 2 and 3 are opened flat and positioned one over the other with the folding score lines 12 not aligned and grooved edge 4 of the top element 3 towards the rear and the grooved edge **4*a* of bottom element 2 towards the front. With a pair of corresponding, centrally located tabs 7** of the lower element 2 raised, the notches 9 of the top element are engaged to position the two elements for warping.

The end of a continuous warp thread is engaged in a starting notch 10 of the forward base element 2. With the base flat and extending over the edge of a table or other support 13, the warp thread is wrapped loosely in a continuous fashion around both sides of the assembled base 1, being engaged in successive notches 4 and 4*a* which serve to uniformly space the warp. When a sufficient width of warp has been prepared, the free end is secured to the opposite holding notch 10*a* on the forward base element 2. Each of the warp ends is now released, in turn, and the free end tied to the adjacent warp thread near the front base edge 4*a*. The warp is now free to rotate, in its entirety, around the loom as it has no fixed attachment. The lease sticks 1 are woven under and over successive warp threads, each stick weaving under alternate threads, and then tied together at the ends. These sticks define the two working sheds and maintain alignment of the warp threads.

Figure 4:
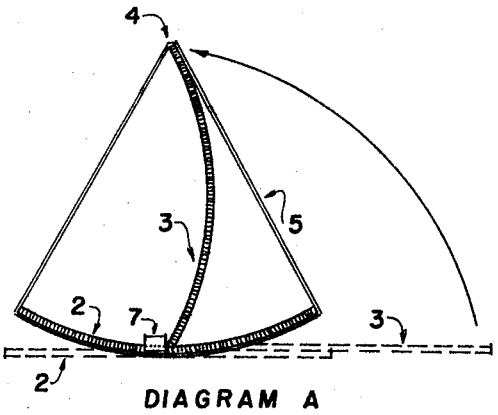
FIG. 4 is an end view of the loom illustrating tensioning proceedure.
Figure 4:
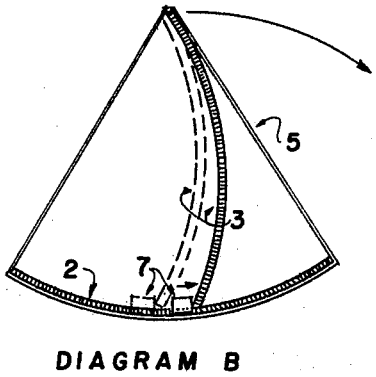

To weave, the warp threads are made taut by increasing the lateral dimension of the loom, causing it to bow and exert an outward force on the warp. Referring to FIG. 4, diagram A, holding the bottom base element 2 down, swing the top base element 3 up from the rear, letting the warp threads slide through their respective notches 4, both elements bending slightly outward due to the restriction of the warp. In this position, illustrated by FIG. 4, diagram B, the inner edge of base element 3, where it is in contact with base element 2, is easily moved forward or backward. For tensioning, swing this edge back past one or two tab positions and raise two new corresponding tabs 7 in front of this edge. Return the two base elements to their working position by pressing down on the inner edge of the rear element 3, till it is in contact with element 2. The two elements of the base, acting together, will assume a bowed position exerting an outward pressure, tensioning the warp. Because of the flexible nature of the base material, the base will tend to provide an equalized tension on all threads.

Figure 5:
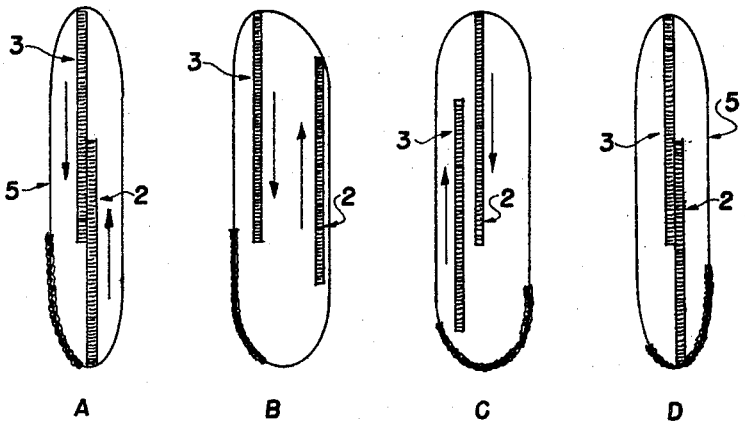
FIG. 5 is an end view of the loom showing movement of base elements as required to rotate warp.

Begin weaving at the front edge 4*a* by using a needle or other common weaving technique. When the work reaches a point where it is difficult to proceed because of the short length of exposed warp, the warp is rotated, exposing the unworked warp from the back of the loom to the front and placing the worked section of the warp at the back. The point where rotation is necessary will vary depending on the weaving technique used. To rotate the warp, eliminate the tension in the warp by pressing both restraining tabs 7 down, disengaging the two base elements. Referring to FIG. 5, hold both elements vertical, one in each hand, and rotate them while maintaining them in this vertical position. The entire warp is easily lifted by the back element and transferred to the front element in a rotated position. Repeat as necessary till the working edge of the weaving nears the front loom edge. Retension the warp by putting the base into a bowed position as described above. Slide the lease sticks 11 toward the back edge 4 of the base, realigning any crossed warp threads. Starting at one end of the warps, position all warp threads in their original edge notches along edge 4. Continue weaving on the newly exposed warp threads. When weaving is stopped for any length of time, it is a good practice to reduce warp tension to avoid warp stretch and to prevent the loom material from assuming a permanent set. This is accomplished by moving the rear element 3, to a more forward set of tabs 7. As weaving proceeds, the warp will shorten due to warp take-up. When the bowing of the base or tension becomes excessive, move the rear base element 3, to a more forward set of tabs 7, reducing the lateral dimension of the loom.

With both base elements identical, top and bottom pieces can be exchanged, the unused tabs of the previous top element now able to be used. This feature is useful should there be failure of the tabs and can thus extend the useful life of the loom. With edge warp notches 4 provided on both longitudional edges of both base elements, both elements can be rotated and used in new positions. Should a bowed permanent 'set' in the base elements occur, preventing adequate tension, the curvature or bowing can be reversed and the weaving can proceed on the opposite side of the loom.

I claim:

1. A loom including

Two normally rigid flat base elements capable of being folded along lateral axes and, adapted to be joined in any of several positions, together forming a single flexible base adapted to receive warp yarn so as to be bowed along a longitudional axis having front and back surfaces so that the tendency of the base to return to a normal flat condition applies tension to the warp.

2. A loom described in claim 1 in which an element of said two element base has an adjustable lateral tabs operative to control warp tension and permit rotation of the warp.

3. A loom as claimed in claim 1 in which the warp is continuous around both front and back surfaces and not attached in any fixed position to these surfaces.

* * * * *